US008568167B2

(12) United States Patent
Montena

(10) Patent No.: US 8,568,167 B2
(45) **Date of Patent: *Oct. 29, 2013**

(54) COAXIAL CABLE CONNECTOR HAVING A BREAKAWAY COMPRESSION SLEEVE

(75) Inventor: Noah Montena, Syracuse, NY (US)

(73) Assignee: PPC Broadband, Inc., East Syracuse, NY (US)

( * ) Notice: Subject to any disclaimer, the term of this patent is extended or adjusted under 35 U.S.C. 154(b) by 82 days.

This patent is subject to a terminal disclaimer.

(21) Appl. No.: 13/191,562

(22) Filed: Jul. 27, 2011

(65) Prior Publication Data

US 2013/0029513 A1 Jan. 31, 2013

(51) Int. Cl.
*H01R 9/05* (2006.01)

(52) U.S. Cl.
USPC ..... 439/584; 439/578

(58) Field of Classification Search
USPC ..... 439/320, 578–585
See application file for complete search history.

(56) References Cited

U.S. PATENT DOCUMENTS

| | | | | |
|---|---|---|---|---|
| 3,375,485 | A | 3/1968 | Donohue et al. | |
| 3,743,324 | A | 7/1973 | Schwarz et al. | |
| 4,156,554 | A * | 5/1979 | Aujla | 439/584 |
| 4,834,675 | A | 5/1989 | Samchisen | |
| 5,888,095 | A | 3/1999 | Hussaini | |
| 6,168,455 | B1 | 1/2001 | Hussaini | |
| 6,210,222 | B1 | 4/2001 | Langham et al. | |
| 6,767,248 | B1 | 7/2004 | Hung | |
| 6,769,933 | B2 | 8/2004 | Bence et al. | |
| 6,951,481 | B2 | 10/2005 | Dykstra et al. | |
| 7,112,093 | B1 | 9/2006 | Holland | |
| 7,118,416 | B2 | 10/2006 | Montena et al. | |
| 7,252,546 | B1 | 8/2007 | Holland | |
| 7,264,502 | B2 | 9/2007 | Holland | |
| 7,300,309 | B2 * | 11/2007 | Montena | 439/578 |
| 7,544,094 | B1 * | 6/2009 | Paglia et al. | 439/585 |
| 7,618,276 | B2 * | 11/2009 | Paglia et al. | 439/322 |
| 7,674,132 | B1 * | 3/2010 | Chen | 439/578 |
| 7,997,930 | B2 * | 8/2011 | Ehret et al. | 439/578 |
| 8,029,316 | B2 * | 10/2011 | Snyder et al. | 439/578 |
| 8,303,338 | B2 * | 11/2012 | Chen | 439/583 |
| 8,342,879 | B2 * | 1/2013 | Amidon et al. | 439/584 |
| 2008/0085631 | A1 | 4/2008 | Holland | |
| 2010/0273352 | A1 | 10/2010 | Amidon et al. | |

* cited by examiner

*Primary Examiner* — Thanh Tam Le
(74) *Attorney, Agent, or Firm* — Hiscock & Barclay LLP

(57) ABSTRACT

An outer sleeve of a coaxial cable connector comprising a tubular body operably attached to a coupling member, a compression portion frangibly connected to the tubular body, wherein the compression portion is configured to break away from the tubular body and displace towards the first end of the tubular body within the tubular body upon an axial compressive force is provided. Moreover, a post configured to receive a prepared end of a coaxial cable, a coupling member, axially rotatable with respect to the post, an outer sleeve engageable with the coupling member, the outer sleeve having a first end and a second end, wherein rotation of the outer sleeve rotates the coupling member, and a compression portion structurally integral with the outer sleeve, wherein the compression portion is configured to break apart from the outer sleeve when axially compressed is further provided. Furthermore, associated methods are also provided.

12 Claims, 16 Drawing Sheets

COAXIAL CABLE CONNECTOR HAVING A BREAKAWAY COMPRESSION SLEEVE

FIELD OF TECHNOLOGY

The following relates to connectors used in coaxial cable communication applications, and more specifically to embodiments of a connector having a break-away compression portion attached to an outer sleeve of the connector.

BACKGROUND

Coaxial cable connectors can be found in various environments, and must perform well under adverse conditions. For instance, environmental elements, including dust particles, moisture, and rainwater, can work to create interference problems when metallic conductive connector components corrode, rust, deteriorate or become galvanically incompatible, thereby resulting in intermittent contact, poor electromagnetic shielding, and degradation of the signal quality. To help prevent the ingress of environmental elements, the connectors are typically compressed onto a coaxial cable through operation of a compression sleeve. The compression sleeve is usually a metal ring having an internal geometry that when axially compressed, forms a seal around the coaxial cable jacket to prevent the ingress of environmental elements. Efforts to reduce metallic material in coaxial cable connectors, part counts, and processing time have lead to the consolidation of the connector body and the moveable compression sleeve into one molded piece of plastic, wherein the sleeve portion breaks away from the connector body to compress the connector body onto the coaxial cable jacket. However, the consolidation of the connector body and the compression sleeve complicates the injection molding process used to create the component. Quite often, internal recesses, which are difficult to form, are required to facilitate the fracturing of the compression sleeve from the body. For instance, the steel core pin used as the negative in injection molding include ribs to form the internal recesses, which makes the steel core pin difficult and timely to remove without damaging the component, slowing down the manufacturing process. Additionally, the optimization of the breakaway force to rupture the sleeve from the connector body is a problem with connectors having a one piece connector body-compression sleeve.

Thus, a need exists for an apparatus and method for eliminating the need for difficult core geometry to facilitate the rupture of the compression sleeve portion and simplify and accelerate the manufacturing process of the component.

SUMMARY

A first general aspect relates to an outer sleeve of a coaxial cable connector comprising: a tubular body having a first end and a second end, the first end of the tubular body operably attached to a coupling member, a compression portion frangibly connected to the tubular body proximate the second end, wherein the compression portion is configured to break away from the tubular body and displace towards the first end of the tubular body within the tubular body upon an axial compressive force.

A second general aspect relates to a coaxial cable connector comprising: a post configured to receive a center conductor surrounded by a dielectric of a coaxial cable, a coupling member, axially rotatable with respect to the post, an outer sleeve engageable with the coupling member, the outer sleeve having a first end and a second end, wherein rotation of the outer sleeve rotates the coupling member, and a compression portion structurally integral with the outer sleeve, wherein the compression portion is configured to break apart from the outer sleeve when axially compressed.

A third general aspect relates to a coaxial cable connector comprising: a post having a first end, a second end, and a flange proximate the second end, wherein the post is configured to receive a center conductor surrounded by a dielectric of a coaxial cable, a coupling member operably attached to the post, the coupling member having a first end and a second end, and a means for providing a seal around the coaxial cable, wherein the means includes a breakaway compression portion frangibly connected to an outer sleeve.

A fourth general aspect relates to a method of forming a seal around a coaxial cable, comprising: providing a post configured to receive a center conductor surrounded by a dielectric of the coaxial cable, a coupling member, axially rotatable with respect to the post, an outer sleeve engageable with the coupling member, the outer sleeve having a first end and a second end, wherein rotation of the outer sleeve rotates the coupling member, and a compression portion structurally integral with the outer sleeve, and axially compressing the compression portion to rupture a frangible connection between the outer sleeve and the compression portion.

The foregoing and other features of construction and operation will be more readily understood and fully appreciated from the following detailed disclosure, taken in conjunction with accompanying drawings.

BRIEF DESCRIPTION OF THE DRAWINGS

Some of the embodiments will be described in detail, with reference to the following figures, wherein like designations denote like members, wherein.

DETAILED DESCRIPTION

A detailed description of the hereinafter described embodiments of the disclosed apparatus and method are presented herein by way of exemplification and not limitation with reference to the Figures. Although certain embodiments are shown and described in detail, it should be understood that various changes and modifications may be made without departing from the scope of the appended claims. The scope of the present disclosure will in no way be limited to the number of constituting components, the materials thereof, the shapes thereof, the relative arrangement thereof, etc., and are disclosed simply as an example of embodiments of the present disclosure.

As a preface to the detailed description, it should be noted that, as used in this specification and the appended claims, the singular forms "a", "an" and "the" include plural referents, unless the context clearly dictates otherwise.

Figure 1:
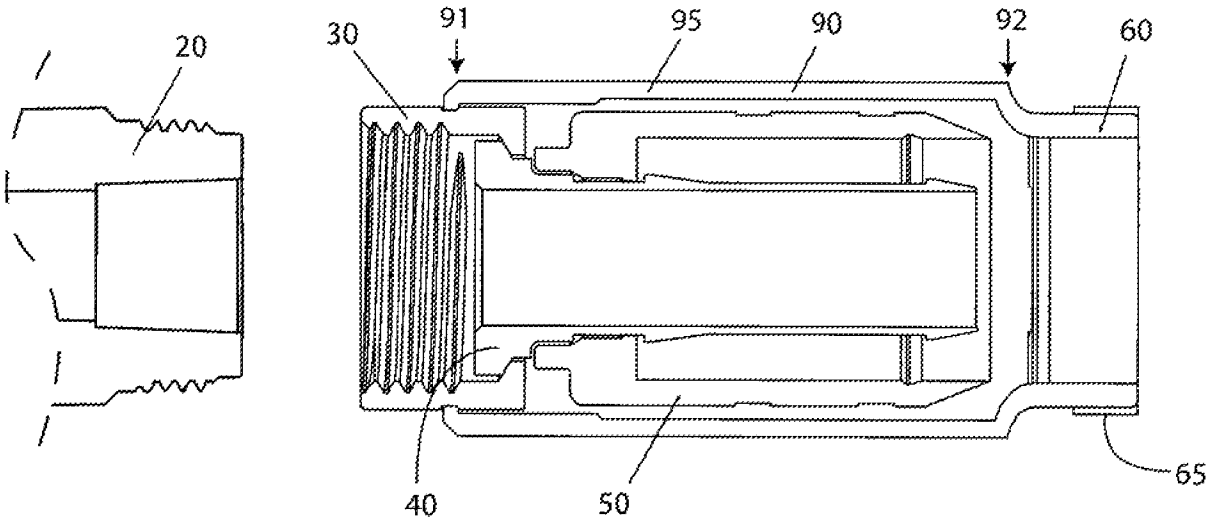
FIG. 1 depicts a cross-sectional view of an embodiment of a coaxial cable connector.
Figure 14:
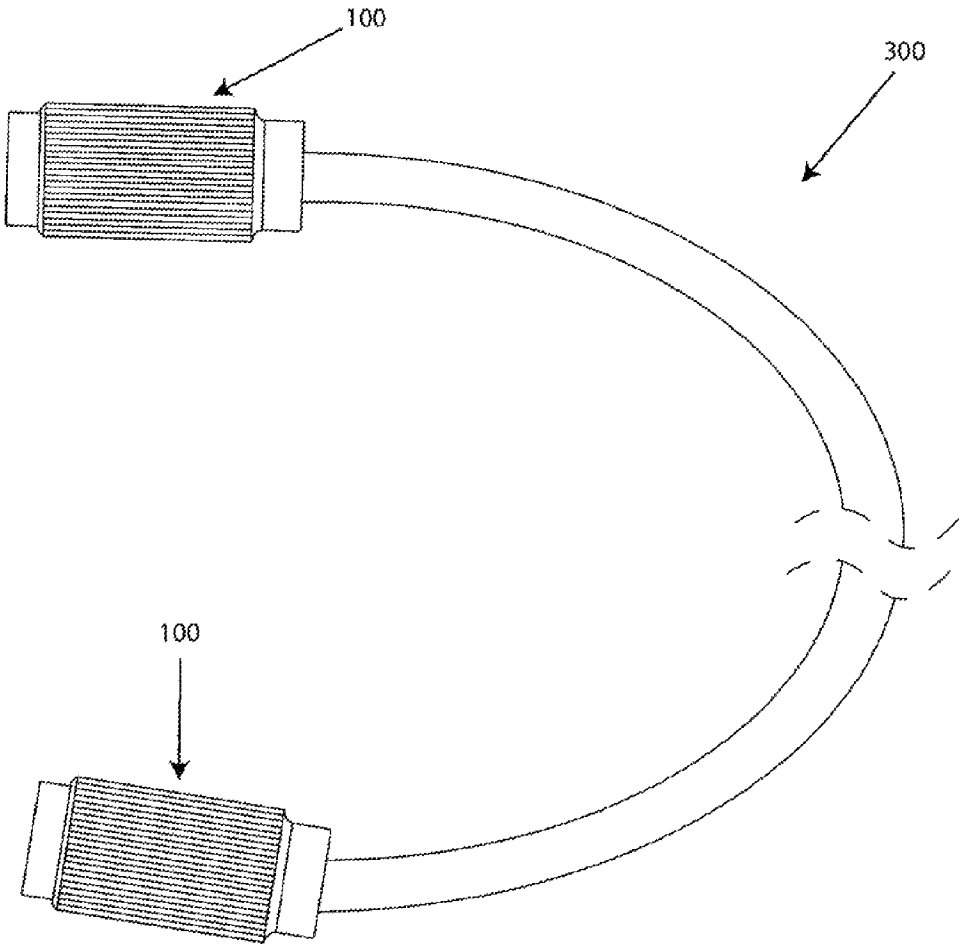
FIG. 14 depicts a perspective view of an embodiment of a jumper.

Referring to the drawings, FIG. 1 depicts an embodiment of a coaxial cable connector 100. A coaxial cable connector embodiment 100 has a first end 1 and a second end 2, and can be provided to a user in a preassembled configuration to ease handling and installation during use. Coaxial cable connector 100 may be an F connector, or similar coaxial cable connector. Two connectors, such as connector 100 may be utilized to create a jumper 300 that may be packaged and sold to a consumer, as shown in FIG. 14. Jumper 300 may be a coaxial cable 10 having a connector, such as connector 100, operably affixed at one end of the cable 10 where the cable 10 has been prepared, and another connector, such as connector 100, operably affixed at the other prepared end of the cable 10. Operably affixed to a prepared end of a cable 10 with respect to a jumper 300 includes both an uncompressed/open position and a compressed/closed position of the connector while affixed to the cable. For example, embodiments of jumper 300 may include a first connector including components/features described in association with connector 100, and a second connector that may also include the components/features as described in association with connector 100, wherein the first connector is operably affixed to a first end of a coaxial cable 10, and the second connector is operably affixed to a second end of the coaxial cable 10. Embodiments of a jumper 300 may include other components, such as one or more signal boosters, molded repeaters, and the like.

Figure 2:
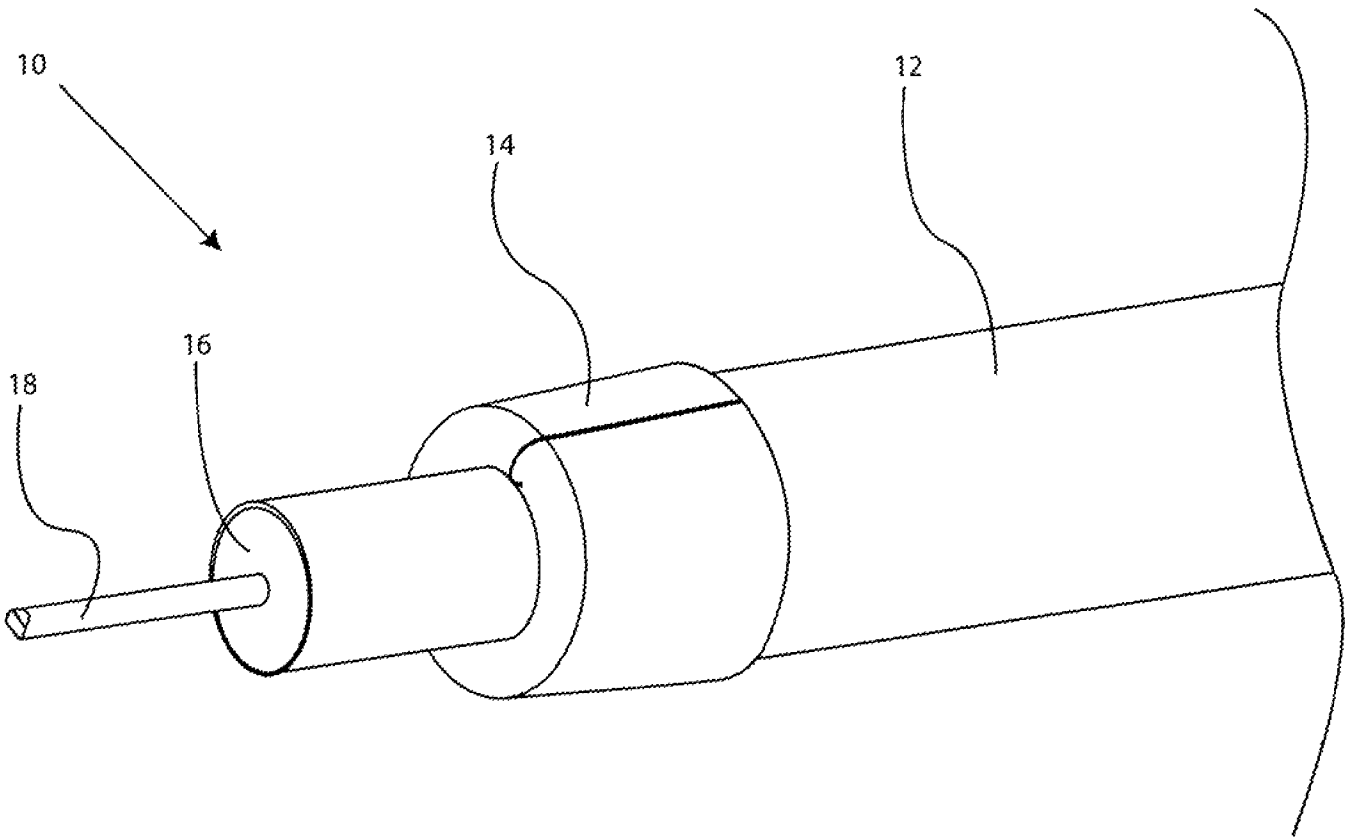
FIG. 2 depicts a perspective view of an embodiment of a coaxial cable.

Referring now to FIG. 2, the coaxial cable connector 100 may be operably affixed to a prepared end of a coaxial cable 10 so that the cable 10 is securely attached to the connector 100. The coaxial cable 10 may include a center conductive strand 18, surrounded by an interior dielectric 16; the interior dielectric 16 may possibly be surrounded by a conductive foil layer; the interior dielectric 16 (and the possible conductive foil layer) is surrounded by a conductive strand layer 14; the conductive strand layer 14 is surrounded by a protective outer jacket 12*a*, wherein the protective outer jacket 12 has dielectric properties and serves as an insulator. The conductive strand layer 14 may extend a grounding path providing an electromagnetic shield about the center conductive strand 18 of the coaxial cable 10. The coaxial cable 10 may be prepared by removing the protective outer jacket 12 and drawing back the conductive strand layer 14 to expose a portion of the interior dielectric 16 (and possibly the conductive foil layer that may tightly surround the interior dielectric 16) and center conductive strand 18. The protective outer jacket 12 can physically protect the various components of the coaxial cable 10 from damage which may result from exposure to dirt or moisture, and from corrosion. Moreover, the protective outer jacket 12 may serve in some measure to secure the various components of the coaxial cable 10 in a contained cable design that protects the cable 10 from damage related to movement during cable installation. However, when the protective outer jacket 12 is exposed to the environment, rain and other environmental pollutants may travel down the protective outer jack 12. The conductive strand layer 14 can be comprised of conductive materials suitable for carrying electromagnetic signals and/or providing an electrical ground connection or electrical path connection. The conductive strand layer 14 may also be a conductive layer, braided layer, and the like. Various embodiments of the conductive strand layer 14 may be employed to screen unwanted noise. For instance, the conductive strand layer 14 may comprise a metal foil (in addition to the possible conductive foil) wrapped around the dielectric 16 and/or several conductive strands formed in a continuous braid around the dielectric 16. Combinations of foil and/or braided strands may be utilized wherein the conductive strand layer 14 may comprise a foil layer, then a braided layer, and then a foil layer. Those in the art will appreciate that various layer combinations may be implemented in order for the conductive strand layer 14 to effectuate an electromagnetic buffer helping to prevent ingress of environmental noise or unwanted noise that may disrupt broadband communications. In some embodiments, there may be flooding compounds protecting the conductive strand layer 14. The dielectric 16 may be comprised of materials suitable for electrical insulation. The protective outer jacket 12 may also be comprised of materials suitable for electrical insulation. It should be noted that the various materials of which all the various components of the coaxial cable 10 should have some degree of elasticity allowing the cable 10 to flex or bend in accordance with traditional broadband communications standards, installation methods and/or equipment. It should further be recognized that the radial thickness of the coaxial cable 10, protective outer jacket 12, conductive strand layer 14, possible conductive foil layer, interior dielectric 16 and/or center conductive strand 18 may vary based upon generally recognized parameters corresponding to broadband communication standards and/or equipment.

Referring back to FIG. 1, the connector 100 may mate with a coaxial cable interface port 20. The coaxial cable interface port 20 includes a conductive receptacle 22 for receiving a portion of a coaxial cable center conductor 18 sufficient to make adequate electrical contact. The coaxial cable interface port 20 may further comprise a threaded exterior surface 24. However, various embodiments may employ a smooth surface, as opposed to threaded exterior surface. In addition, the coaxial cable interface port 20 may comprise a mating edge 26. It should be recognized that the radial thickness and/or the length of the coaxial cable interface port 20 and/or the conductive receptacle 22 may vary based upon generally recognized parameters corresponding to broadband communication standards and/or equipment. Moreover, the pitch and depth of threads which may be formed upon the threaded exterior surface 24 of the coaxial cable interface port 20 may also vary based upon generally recognized parameters corresponding to broadband communication standards and/or equipment. Furthermore, it should be noted that the interface port 20 may be formed of a single conductive material, multiple conductive materials, or may be configured with both conductive and non-conductive materials corresponding to the port's 20 electrical interface with a coaxial cable connector, such as connector 100. For example, the threaded exterior surface may be fabricated from a conductive material, while the material comprising the mating edge 26 may be non-conductive or vice versa. However, the conductive receptacle 22 should be formed of a conductive material. Further still, it will be understood by those of ordinary skill that the interface port 20 may be embodied by a connective interface component of a communications modifying device such as a signal splitter, a cable line extender, a cable network module and/or the like.

Referring further to FIG. 1, embodiments of a connector 100 may include a post 40, a coupling member 30, a connector body 50, an outer sleeve 90, a compression portion 60, and a radial restriction member 65. Embodiments of coupling member 30 may include coupling member 30*a* and 30*b*, described in greater detail infra. Similarly, embodiments of outer sleeve 90 may include outer sleeve 90*a* and 90*b*, described in greater detail infra. For instance, embodiments of outer sleeve 90 may include a tubular body 95 having a first end 91 and a second end 92, the first end 91 of the tubular body 95 operably attached to a coupling member 30, and a compression portion 60 frangibly connected to the tubular body 95 proximate the second end 92, wherein the compression portion 60 is configured to break away from the tubular body 95 and displace towards the first end 91 of the tubular body 95 within the tubular body 95 upon an axial compressive force. Embodiments of connector 100 may include a post 40 configured to receive a center conductor 18 surrounded by a dielectric 16 of a coaxial cable 10, a coupling member 30, axially rotatable with respect to the post 40, an outer sleeve 90 engageable with the coupling member 30, the outer sleeve 90 having a first end 91 and a second end 92, wherein rotation of the outer sleeve 90 rotates the coupling member 30, and a compression portion 60 structurally integral with the outer sleeve 90, wherein the compression portion 60 is configured to break apart from the outer sleeve 90 when axially compressed.

Figure 3:
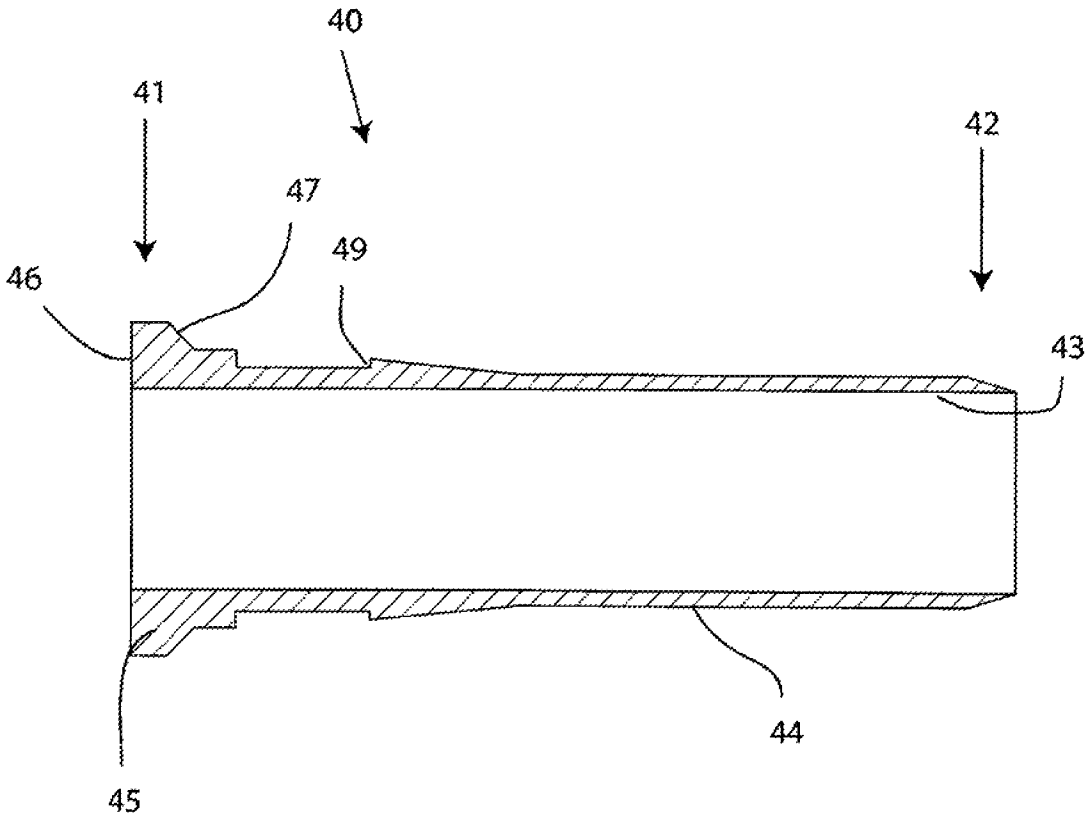
FIG. 3 depicts a cross-sectional view of an embodiment of a post.

Embodiments of connector 100 may include a post 40, as further shown in FIG. 3. The post 40 comprises a first end 41, a second end 42, an inner surface 43, and an outer surface 44. Furthermore, the post 40 may include a flange 45, such as an externally extending annular protrusion, located proximate or otherwise near the first end 41 of the post 40. The flange 45 may include an outer tapered surface 47 facing the second end 42 of the post 40 (i.e. tapers inward toward the second end 42 from a larger outer diameter proximate or otherwise near the first end 41 to a smaller outer diameter. The outer tapered surface 47 of the flange 45 may correspond to a tapered surface of the lip 36 of the coupling member 30. Further still, an embodiment of the post 40 may include a surface feature 49 such as a lip or protrusion that may engage a portion of a connector body 50 to secure axial movement of the post 40 relative to the connector body 50. However, the post 40 may not include such a surface feature 49, and the coaxial cable connector 100 may rely on press-fitting and friction-fitting forces and/or other component structures to help retain the post 40 in secure location both axially and rotationally relative to the connector body 50. The location proximate or otherwise near where the connector body 50 is secured relative to the post 40 may include surface features, such as ridges, grooves, protrusions, or knurling, which may enhance the secure location of the post 40 with respect to the connector body 50. Additionally, the post 40 includes a mating edge 46, which may be configured to make physical and electrical contact with a corresponding mating edge 26 of an interface port 20. The post 40 should be formed such that portions of a prepared coaxial cable 10 including the dielectric 16 and center conductor 18 can pass axially into the second end 42 and/or through a portion of the tube-like body of the post 40. Moreover, the post 40 should be dimensioned such that the post 40 may be inserted into an end of the prepared coaxial cable 10, around the dielectric 16 and under the protective outer jacket 12 and conductive grounding shield or strand 14. Accordingly, where an embodiment of the post 40 may be inserted into an end of the prepared coaxial cable 10 under the drawn back conductive strand 14, substantial physical and/or electrical contact with the strand layer 14 may be accomplished thereby facilitating grounding through the post 40. The post 40 may be formed of metals or other conductive materials that would facilitate a rigidly formed post body. In addition, the post 40 may be formed of a combination of both conductive and non-conductive materials. For example, a metal coating or layer may be applied to a polymer of other non-conductive material. Manufacture of the post 40 may include casting, extruding, cutting, turning, drilling, knurling, injection molding, spraying, blow molding, component overmolding, or other fabrication methods that may provide efficient production of the component.

Figure 4B:
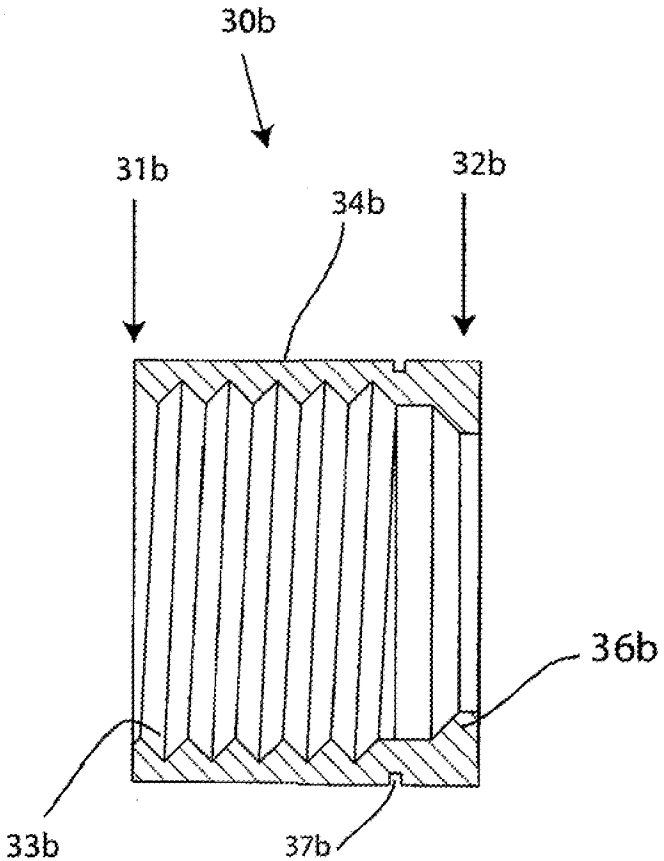
FIG. 4B depicts a cross-sectional view of a second embodiment of a coupling member.
Figure 4A:
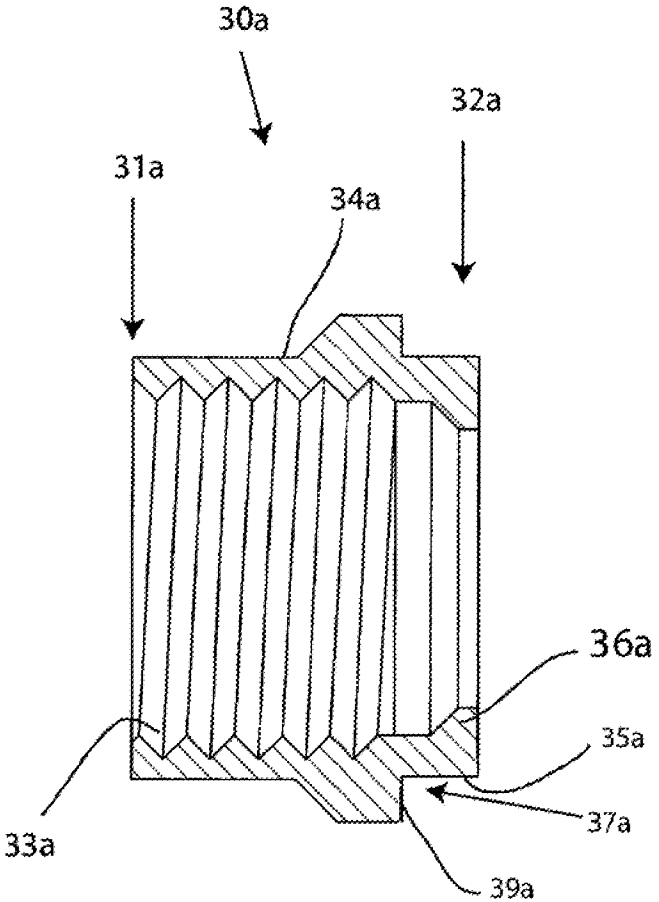
FIG. 4A depicts a cross-sectional view of a first embodiment of a coupling member.

With continued reference to FIG. 1, and further reference to FIG. 4A, embodiments of connector 100 may include a coupling member 30*a*. The coupling member 30*a* may be a nut, a threaded nut, port coupling member, rotatable port coupling member, and the like. The coupling member 30*a* may include a first end 31*a*, second end 32*a*, an inner surface 33*a*, and an outer surface 34*a*. The inner surface 33*a* of the coupling member 30*a* may be a threaded configuration, the threads having a pitch and depth corresponding to a threaded port, such as interface port 20. In other embodiments, the inner surface 33*a* of the coupling member 30*a* may not include threads, and may be axially inserted over an interface port, such as port 20. The coupling member 30*a* may be rotatably secured to the post 40 to allow for rotational movement about the post 40. The coupling member 30*a* may comprise an internal lip 36*a* located proximate the second end 32*a* and configured to hinder axial movement of the post 40. Furthermore, the coupling member 30*a* may include a retaining structure 37*a* for retaining and/or matably engaging an outer sleeve 90. Embodiments of the retaining structure 37*a* may be an outer annular recess 35*a* and edge 39*a* proximate the second end 32*a* to accommodate an outer sleeve 90. For instance, a first end 91 of the outer sleeve 90 may reside contiguous the coupling member 30*a*, wherein an inner surface 93 proximate the first end 91 of the outer sleeve 90 physically contacts the outer annular recess 35*a* of the coupling member 30*a* when the outer sleeve 90 is operably attached to the coupling member 30*a*.

With continued reference to FIG. 1, and further reference to FIG. 4B, embodiments of connector 100 may include a coupling member 30*b*. Coupling member 30*b* may share some of the structural and functional aspects of coupling member 30*a*, such as being mated, threaded or otherwise, to a corresponding interface port 20. Further, the coupling member 30*b* may include a first end 31*b*, a second end 32*b*, an inner surface 33*b*, an outer surface 34*b*, an internal lip 36*b*, such as an annular protrusion, located proximate the second rearward end 32*b* of the coupling member 30*b*, wherein the internal lip 36*b* includes a surface 35*b* facing the first forward end 31*b* of the coupling member 30*b*. However, coupling member 30*b* may be defined by a generally cylindrical, flat outer surface 34*a*. Located somewhere on the outer surface 34*b* of the coupling member 30*b* may be a retaining structure 37*b*. The retaining structure 37*b* of the coupling member 30*b* may be an annular groove or recess that extends completely or partially around the outer surface 34*b* of the coupling member 30*b* to retain, accommodate, receive, or mate with an engagement member 97 of the outer sleeve 90. Alternatively, the retaining structure 37*b* may be an annular protrusion that extends completely or partially around the outer surface 34*b* of the coupling member 30*b* to retain or mate with the engagement member 97 of the sleeve 90. The retaining structure 37*b* may be placed at various axial positions from the first end 31*b* to the 30*b*, depending on the configuration of the sleeve 90 and other design requirements of connector 100.

With respect to both coupling member 30*a* and 30*b*, the internal lip 36*a*, 36*b* may define the second end 32*a*, 32*b* of the coupling member 30*a*, 30*b*, eliminating excess material from the coupling member 30*a*, 30*b*. Embodiments of coupling member 30*a*, 30*b* may include an outer surface feature 38*a*, 38*b* proximate or otherwise near the second end 32*a*, 32*b*, to improve mechanical interference or friction between the coupling member 30*a*, 30*b* and the sleeve 90. For instance, the outer surface feature 38*a* may extend completely or partially around the outer annular recess 37*a* proximate the second 32*a* of the coupling member 30*a* to increase a retention force between an inner surface 93 of the sleeve 90 and the coupling member 30*a*. Likewise, the outer surface feature 38*b* may extend completely or partially around the outer surface 34*b* proximate the second 32*b* of the coupling member 30*b* to increase a retention force between an inner surface 93 of the sleeve 90 and the coupling member 30*b*. The outer surface feature 38*a*, 38*b* may include a knurled surface, a slotted surface, a plurality of bumps, ridges, grooves, or any surface feature that may facilitate contact between the sleeve 90 and the coupling member 30*a*, 30*b*. In one embodiment, the coupling member 30*b* may be referred to as a press-fit nut. The coupling member 30*a*, 30*b* may be formed of conductive materials facilitating grounding through the coupling member 30*a*, 30*b*. Accordingly the coupling member 30*a*, 30*b* may be configured to extend an electromagnetic buffer by electrically contacting conductive surfaces of an interface port 20 when a coaxial cable connector, such as connector 100, is advanced onto the port 20. In addition, the coupling member 30*a*, 30*b* may be formed of non-conductive material and function only to physically secure and advance a connector 100 onto an interface port 20. Moreover, the coupling member 30*a*, 30*b* may be formed of both conductive and non-conductive materials. For example the internal lip 36*a*, 36*b* may be formed of a polymer, while the remainder of the coupling member 30*a*, 30*b* may be comprised of a metal or other conductive material. In addition, the coupling member 30*a*, 30*b* may be formed of metals or polymers, plastics, or other materials that would facilitate a rigidly formed body. Manufacture of the coupling member 30*a*, 30*b* may include casting, extruding, cutting, turning, tapping, drilling, injection molding, blow molding, or other fabrication methods that may provide efficient production of the component.

Figure 5:
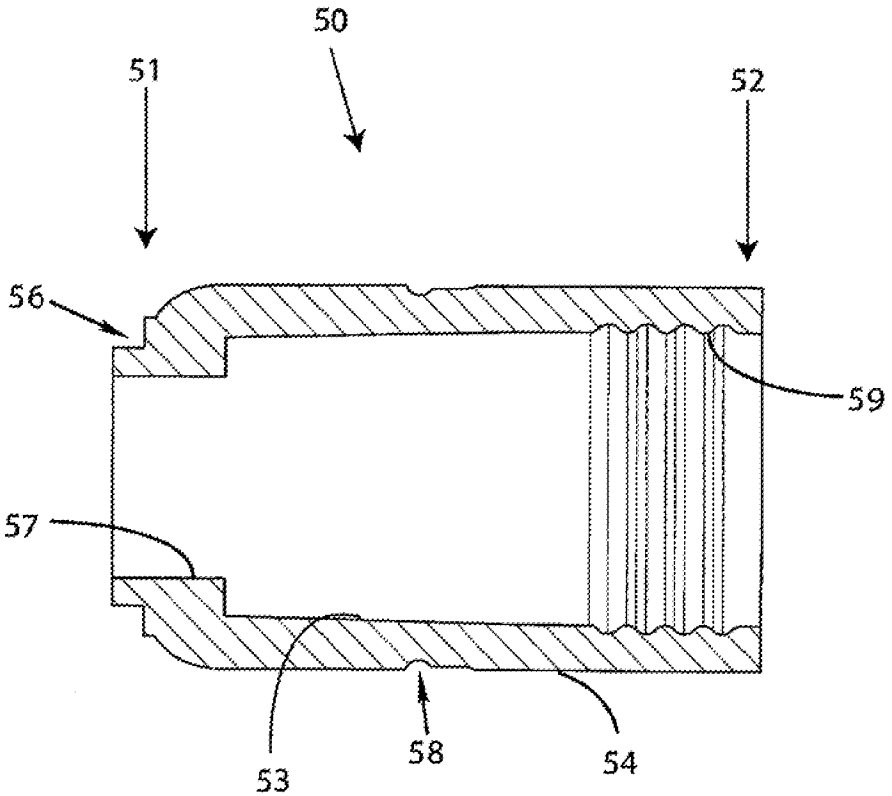
FIG. 5 depicts a cross-sectional view of a first embodiment of a connector body.

Referring still to FIG. 1, and additionally to FIG. 5, embodiments of a coaxial cable connector, such as connector 100, may include a connector body 50. The connector body 50 may include a first end 51, a second end 52, an inner surface 53, and an outer surface 54. Moreover, the connector body may include a post mounting portion 57 proximate or otherwise near the first end 51 of the body 50; the post mounting portion 57 configured to securely locate the body 50 relative to a portion of the outer surface 44 of post 40, so that the connector body 50 is axially secured with respect to the post 40, in a manner that prevents the two components from moving with respect to each other in a direction parallel to the axis of the connector 100. In addition, the connector body 50 may include an outer annular recess 56 located proximate or near the first end 51 of the connector body 50. Furthermore, the connector body 50 may include a semi-rigid, yet compliant outer surface 54, wherein the outer surface 54 may be configured to form an annular seal when the second end 52 is deformably compressed against a received coaxial cable 10 by the compression portion 60 of the outer sleeve 90. The second end 52 of the connector body 50 may include an outer ramped surface 55. The connector body 50 may include an external annular detent 58 located along the outer surface 54 of the connector body 50. Further still, the connector body 50 may include internal surface features 59, such as annular serrations formed near or proximate the internal surface of the second end 52 of the connector body 50 and configured to enhance frictional restraint and gripping of an inserted and received coaxial cable 10, through tooth-like interaction with the cable. The connector body 50 may be formed of materials such as plastics, polymers, bendable metals or composite materials that facilitate a semi-rigid, yet compliant outer surface 54. Further, the connector body 50 may be formed of conductive or non-conductive materials or a combination thereof. Manufacture of the connector body 50 may include casting, extruding, cutting, turning, drilling, knurling, injection molding, spraying, blow molding, component overmolding, combinations thereof, or other fabrication methods that may provide efficient production of the component.

Figure 6A:
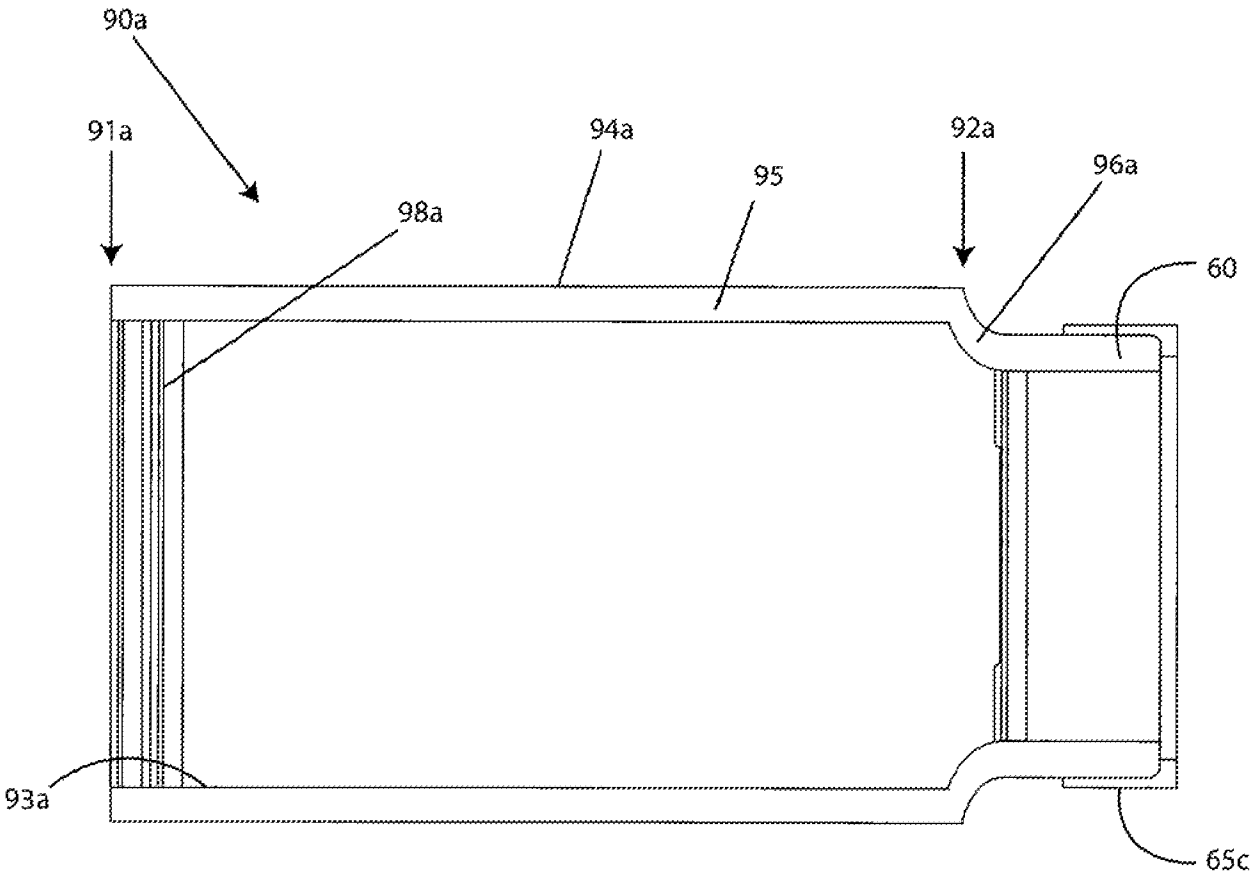
FIG. 6A depicts a cross-sectional view of a first embodiment of an outer sleeve.
Figure 6B:
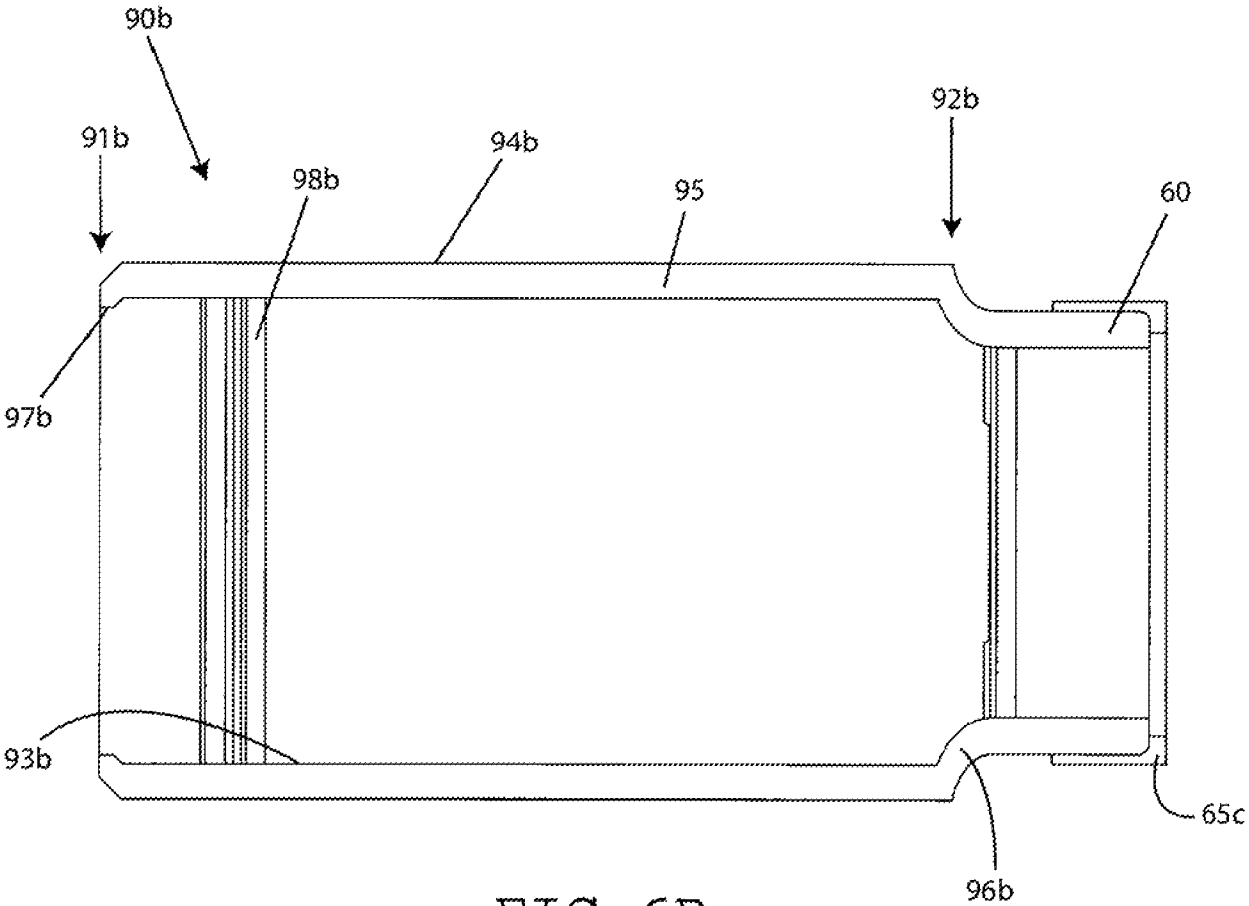
FIG. 6B depicts a cross-sectional view of a second embodiment of an outer sleeve.
Figure 6C:
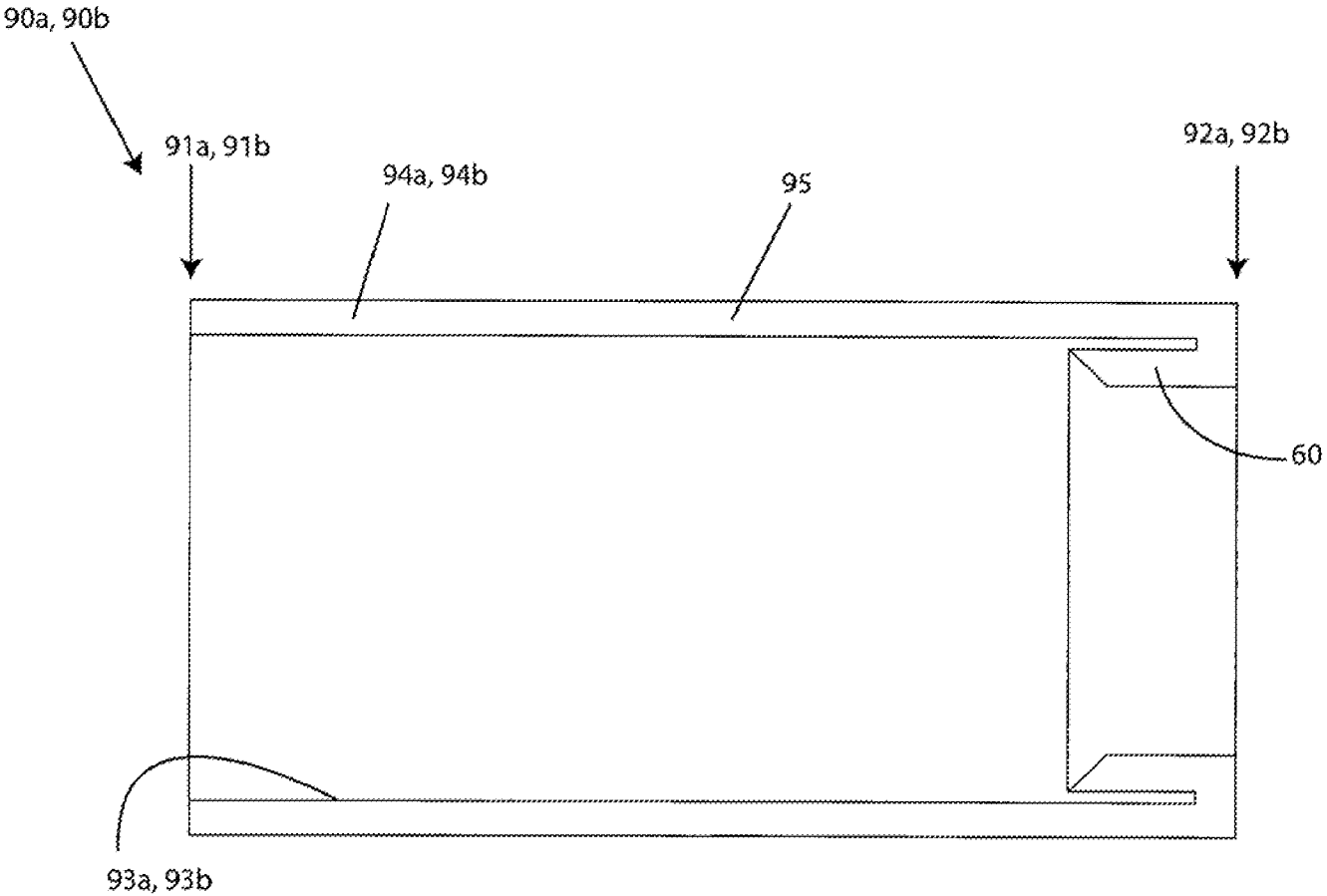
FIG. 6C depicts a cross-sectional view of a third embodiment of an outer sleeve.

With further reference to FIG. 1 and FIG. 6A, embodiments of connector 100 may include an outer sleeve 90*a*. The sleeve 90*a* may be engageable with the coupling member 30*a*. The sleeve 90*a* may include a first end 91*a*, a second end 92*a*, an inner surface 93*a*, and an outer surface 94*a*. The sleeve 90*a* may be a generally annular member having a generally axial opening therethrough. The sleeve 90*a* may be radially disposed over the coupling member 30*a*, or a portion thereof, the post 40, and the connector body 50, or a portion thereof (and the compression portion 60 and radial restriction member 65, or a portion thereof, while in a compressed position). The first end 91*a* of the outer sleeve 90*a* may matably engage the retaining structure 37*a* of the coupling member 30*a*. For instance, the outer sleeve 90*a* and the coupling member 30*a* may be press-fit to establish sufficient mechanical interference between the components such that torque applied to the outer sleeve 90*a* transfers to torque/rotation of the coupling member 30*a*. Furthermore, the inner surface 93*a* of the outer sleeve 90*a* and the outer annular recess 35*a* may be press-fit to prevent and/or hinder axial movement of the sleeve 90*a* with respect to the coupling member 30*a*.

Embodiments of connector 100 may also include an outer sleeve 90*b*. Embodiments of the outer sleeve 90*b* may share the same or substantially the same structural and functional aspects of outer sleeve 90*a*. For example, the outer sleeve 90*b* may include a first end 91*b*, a second end 92*b*, an inner surface 93*b*, and an outer surface 94*b*. However, proximate or otherwise near the first end 91*b*, the sleeve 90*b* may include an engagement member 97*b* configured to mate or engage with the retaining structure 37*b* of the coupling member 30*b*. The engagement member 97*b* may be an annular lip or protrusion that may enter or reside within the retaining structure 37*b* of the coupling member 30*b*. For example, in embodiments where the retaining structure 37*b* is an annular groove, the engagement member 97*b* may be a protrusion or lip that may snap into the groove located on the coupling member 30*b* to retain the sleeve 90*b* in a single axial position. In other words, the cooperating surfaces of the groove-like retaining structure 37*b* and the lip or protruding engagement member 97*b* may prevent axial movement of the sleeve 90*b* once the connector 100 is in an assembled configuration. Alternatively, the engagement member 97*b* may be an annular groove or recess that may receive or engage with the retaining structure 37*b* of the coupling member 30*b*. For example, in embodiments where the retaining structure 37*b* of the coupling member 30*b* is an annular protrusion, the engagement member 97*b* may be a groove or recess that may allow the annular protruding retaining structure 37*b* of the coupling member 30*b* to snap into to retain the sleeve 90*b* in a single axial position. In other words, the cooperating surfaces of the protruding retaining structure 37*b* and the groove-like engagement member 97*b* may prevent axial movement of the sleeve 90*b* once the connector 100 is in an assembled configuration. Those having skill in the art should understand that various surface features effectuating cooperating surfaces between the coupling member 30 and the sleeve 90 may be implemented to retain the sleeve 90 with respect to the rest of the connector 100 in an axial direction. Furthermore, the engagement member 97*b* of the sleeve 90*b* may be segmented such that one or more gaps may separate portions of the engagement member 97*b*, while still providing sufficient structural engagement with the retaining structure 37*b*.

Referring now to FIGS. 1, 6A-7, an assembled configuration of connector 100 with respect to the sleeve 90*a* and 90*b* may involve sliding the sleeve 90*a*, 90*b* over the coupling member 30 in an axial direction until sufficient mating and/or engagement occurs between the inner surface 93*a* proximate the first end 91*a* of the outer sleeve 90*a* and the outer annular recess 35*a*, or until sufficient mating and/or engagement occurs between the engagement member 97*b* of the sleeve 90*b* and the retaining structure 37*b* of the coupling member 30*b*. Once in the assembled configuration, rotation of the sleeve 90*a*, 90*b* may in turn cause the coupling member 30 to simultaneously rotate in the same direction as the sleeve 90*a*, 90*b* due to mechanical interference between the inner surface 93*a*, 93*b* of the sleeve 90*a*, 90*b* and the outer surface 34*a*, 34*b* of the coupling member 30*a*, 30*b*. In some embodiments, the interference between the sleeve 90*a*, 90*b* and the coupling member 30 relies simply on a friction fit or interference fit between the components. Other embodiments include a coupling member 30 with an outer surface feature 38*a*, 38*b*, as described supra, to improve the mechanical interference between the components. Further embodiments include a sleeve 90*a*, 90*b* with internal surface features 98*a*, 98*b* positioned on the inner surface 93*a*, 93*b* to improve the contact between the components. Even further embodiments of connector 100 may include a sleeve 90*a*, 90*b* and a coupling member 30*a*, 30*b* both having surface features 98*a*, 98*b*, 38*a*, 38*b*, respectively. Embodiments of the inner surface features 98*a*, 98*b* of the sleeve 90*a*, 90*b* may include a knurled surface, a slotted surface, a plurality of bumps, ridges, grooves, ribs, or any surface feature that may facilitate contact between the sleeve 90*a*, 90*b* and the coupling member 30. In many embodiments, the inner surface features 98*a*, 98*b* of the sleeve 90*a*, 90*b* and the inner surface features 38*a*, 38*b* of the coupling member 30*a*, 30*b* may structurally correspond with each other.

Figure 7A:
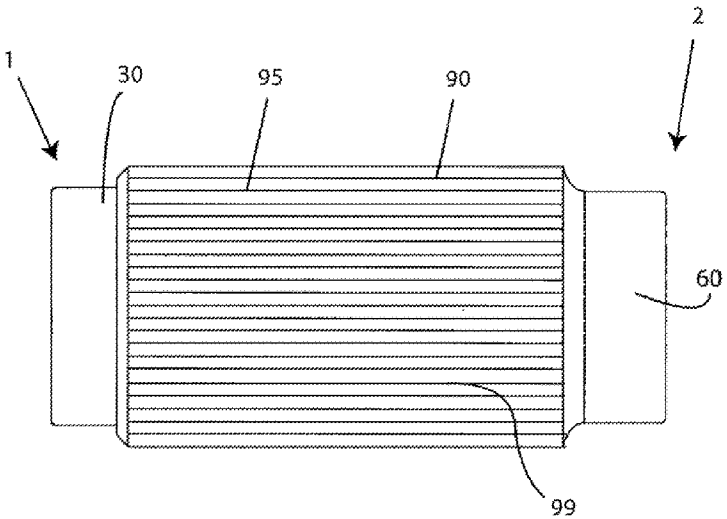
FIG. 7A depicts a side view of an embodiment of the coaxial cable connector.
Figure 7B:
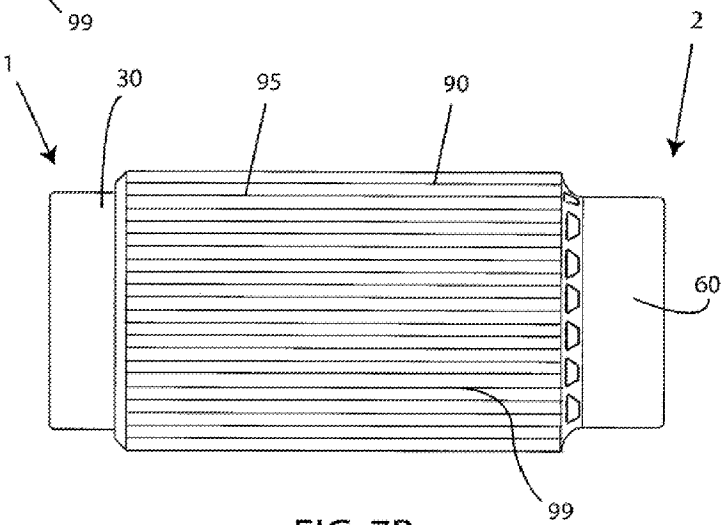
FIG. 7B depicts a side view of an embodiment of the coaxial cable connector with openings along a frangible connection.

Due to the engagement between the outer sleeve 90 and the coupling member 30, a user may simply grip and rotate/twist the sleeve 90 to thread the coupling member 30 onto an interface port, such as interface port 20. Further still, embodiments of the sleeve 90 may include outer surface features 99 (as shown in FIGS. 7A and 7B), such as annular serrations or slots, configured to enhance gripping of the sleeve 90 while connecting the connector 100 onto an interface port. The sleeve 90 may be formed of materials such as plastics, polymers, bendable metals or composite materials that facilitate a rigid body. Further, the sleeve 90 may be formed of conductive or non-conductive materials or a combination thereof. Manufacture of the sleeve 90 may include casting, extruding, cutting, turning, drilling, knurling, injection molding, spraying, blow molding, component overmolding, combinations thereof, or other fabrication methods that may provide efficient production of the component.

Figure 10:
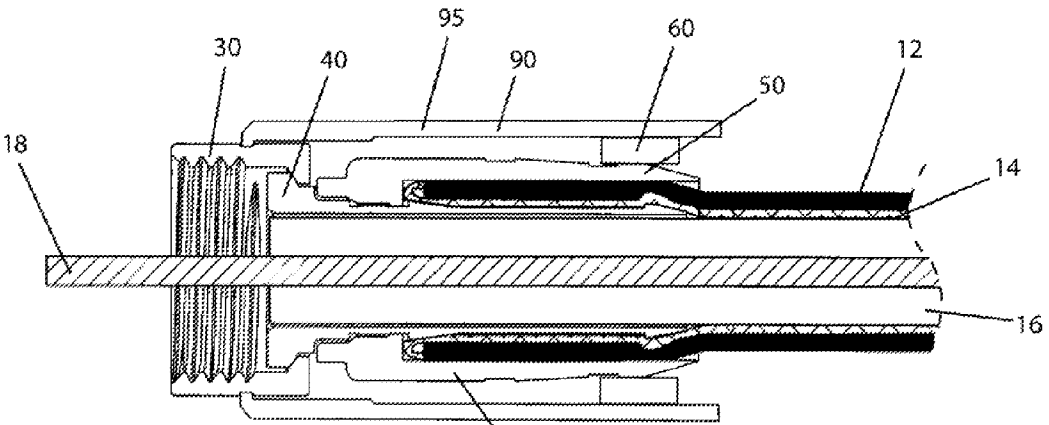
FIG. 10 depicts a cross-sectional view of an embodiment of the coaxial cable connector affixed to a prepared end of the coaxial cable, after compression, forming a seal around the coaxial cable.

Referring still to FIGS. 1 and 6A-7B, embodiments of connector 100 may include a compression portion 60. The outer sleeve 90 may include a compression portion 60 configured to break away from the outer sleeve 90 when axially compressed. In some embodiments, when the compression portion 60 is axially compressed, the connector body 50, in particular, the second end 52 of the connector body 50 onto the coaxial cable 10. Compression portion 60 may be operably attached to the outer sleeve 90. For instance, the compression portion 60 may be structurally integral with the outer sleeve 90, wherein the compression portion 60 separates from the outer sleeve 90 upon an axial force which in turn radially compresses the second end 52 of the connector body 50 onto the coaxial cable 10, as shown in FIG. 10. In other words, the outer sleeve 90 may include a frangible connection 96*a*, 96*b* proximate or otherwise near the second end 92*a*, 92*b* of the sleeve 90, wherein the frangible connection 96*a*, 96*b* structurally connects the compression portion 60 to the outer sleeve 90*a*, 90*b*. The structural yet frangible connection 96*a*, 96*b* between the outer sleeve 90 and the compression portion 60 may be thin or otherwise breakable when compressive, axial force is applied (e.g. by an axial compression tool). The frangible connection 96*a*, 96*b* may be a continuous, solid connection having a thin cross-section between the outer sleeve 90 and the compression portion 60 (as shown in FIG. 7A). Other embodiments of the frangible connection 96*a*, 96*b* may be a continuous web connection. Further embodiments of the frangible connection 96*a*, 96*b* may be slotted or include segmented openings (as shown in FIG. 7B). The compression portion 60 may be initially protruding from the second end 92*a*, 92*b* of the outer sleeve 90*a*, 90*b*, or may initially reside within the generally axial opening of the outer sleeve 90 (as shown in FIG. 6C) prior to compression (but possibly after connector 100 is in a assembled configuration).

Moreover, the compression portion 60 can be formed of the same material as outer sleeve 90, and the one-piece component (such as a plastic, one-piece molded component comprising the outer sleeve 90 and compression portion 60) can be produced during the same injection molding or other manufacturing process. Because the inner surface 93 of the sleeve 90 can be smooth, or otherwise devoid of internal recesses and other surface features, removal of a steel core pin used as a negative during an injection molding process may be easily removed. For instance, the steel core pin may not include ribs or other protrusions that can rupture/break/snap the frangible connection 96 when removing the core pin. Additionally, because the outer sleeve 90 and the integrally connected compression portion 60 may be essentially cylindrical, two core pin halves may be used during the injection molding process to create clean lines of draw. The compression portion 60 may be comprised of materials such as plastics, polymers, bendable metals or composite materials that facilitate a rigid body. Further, the compression portion 60 may be formed of conductive or non-conductive materials or a combination thereof. Manufacture of the compression member 60 may include casting, extruding, cutting, turning, drilling, knurling, injection molding, spraying, blow molding, component overmolding, combinations thereof, or other fabrication methods that may provide efficient production of the component.

Furthermore, embodiments of connector 100 may include a radial restriction member 65. Embodiments of a radial restriction member 65 may include radial restriction members 65*a*, 65*b*, 65*c*. Each radial restriction member 65 may surround or partially surround the compression portion 60 to prevent the displacement of the compression portion upon rupture in a direction other than substantially axial (or axial) to facilitate even compression to form a seal around or partially around the cable 10. The radial restriction member 65 may include fingers that may pass/extend through openings in the slotted embodiments of the frangible connection 96*a*, 96*b* to facilitate latching of the outer sleeve 90 to the connector body 50 once it is separated from the outer sleeve 90 (or carrier part).

Figure 8A:
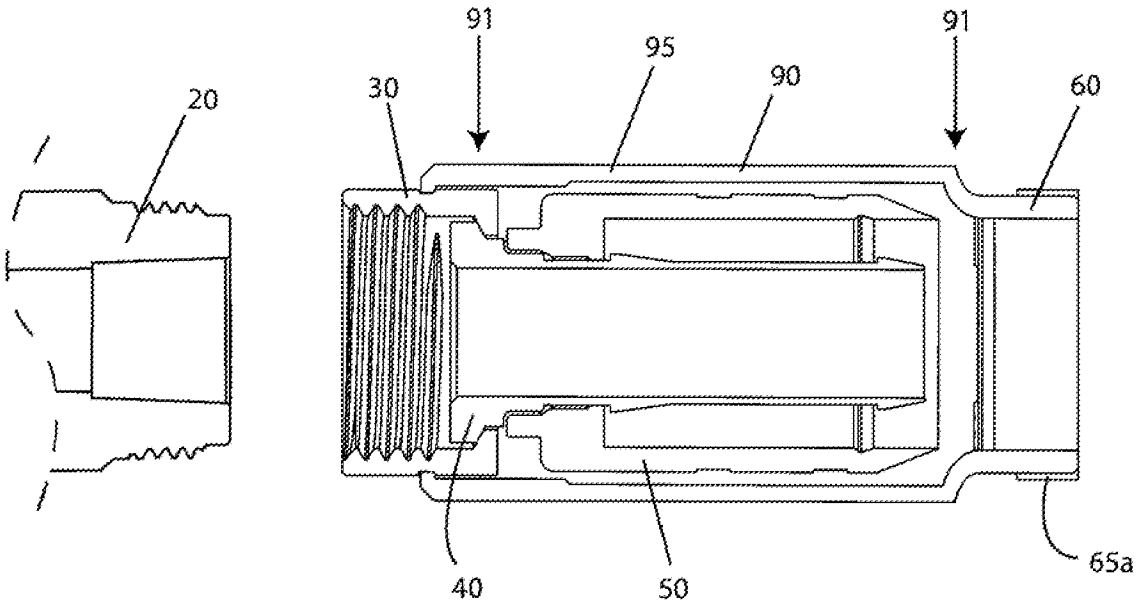
FIG. 8A depicts a cross-sectional view of an embodiment of a coaxial cable connector including a first embodiment of a radial restriction member.

Referring to FIG. 8A, an embodiment of a radial restriction member 65*a* is depicted. Embodiments of radial restriction member 65*a* may be a ring or similar annular tubular member disposed around the compression portion 60. For instance, the radial restriction member 65*a* may surround the compression portion 60. The radial restriction member 1365*a* may be a generally annular, hollow cylindrically-shaped sleeve-like member comprised of stainless steel or other substantially rigid material(s) which may structurally assist the crack and seal process of compression portion 60. For instance, when the compression portion 60 is axially compressed in a direction towards the coupling member 30, the radial restriction member 65*a* may axially displace along with the compression portion 60 and may prevent the compression portion 60 from splintering or otherwise displacing in a direction other than substantially axial towards the coupling member 30.

Figure 8B:
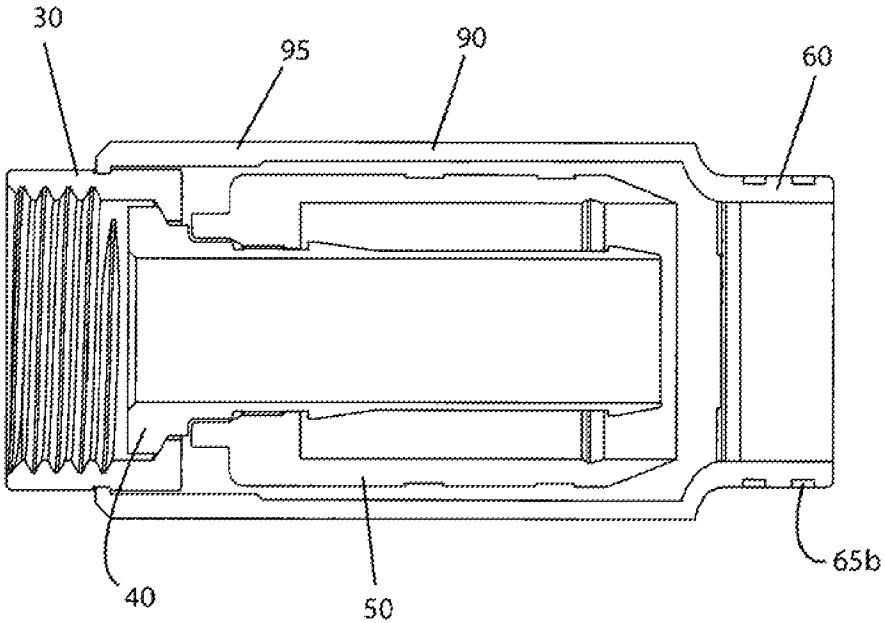
FIG. 8B depicts a cross-sectional view of an embodiment of a coaxial cable connector including a second embodiment of a radial restriction member.

Referring to FIG. 8B, an embodiment of a radial restriction member 65*b* is depicted. Embodiments of radial restriction member 65*b* may share the same or substantially the same function as radial restriction member 65*a*. However, radial restriction member 65*b* may be one or more straps or bands that extend annularly around or partially around the compression portion 60. The radial restriction member 65*b* may be structurally attached to the compression portion 60 in a variety of methods, such as press-fit, adhesion, cohesion, fastened, etc. For instance, the radial restriction member 65*b* may reside within annular notches or grooves in the compression portion 60. The notches or grooves may have various depths to allow the radial restriction member 65*b* to be flush with the outer surface of the compression portion 60, to protrude from the outer surface of the compression portion 60, or to reside completely beneath the outer surface of the compression portion 60. Moreover, the radial restriction member 65*b* may be comprised of stainless steel or other substantially rigid materials which may structurally assist the crack and seal process of compression portion 60. For instance, when the compression portion 60 is axially compressed in a direction towards the coupling member 30, the radial restriction member 65*b* may prevent the compression portion 60 from splintering or otherwise displacing in a direction other than substantially axial towards the coupling member 30.

Figure 8C:
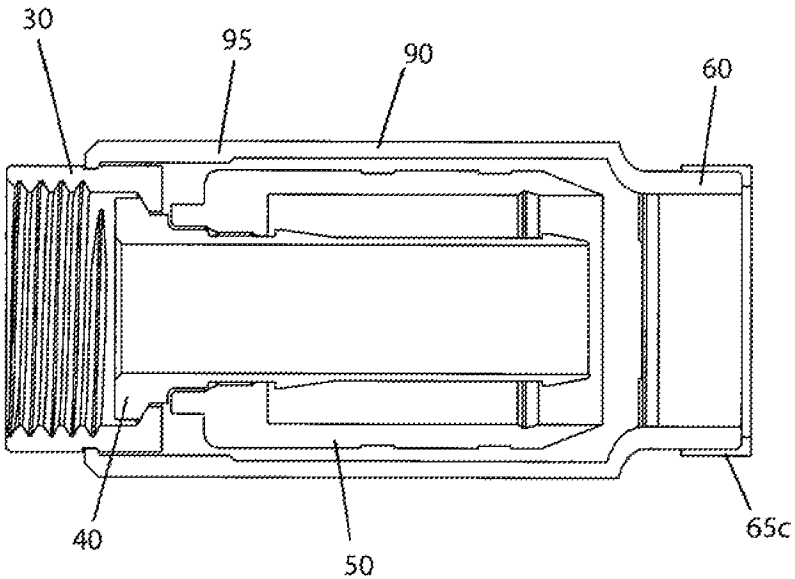
FIG. 8C depicts a cross-sectional view of an embodiment of a coaxial cable connector including a third embodiment of a radial restriction member.

Referring to FIG. 8C, an embodiment of a radial restriction member 65*c* is depicted. Embodiments of radial restriction member 65*c* may share the same or substantially the same function as radial restriction member 65*a*. However, radial restriction member 65*c* may be a cap member, or similar generally annular, tubular member having an engagement surface for operable engagement with a compression tool. For instance, embodiments of the radial restriction member 65*c* may include an internal annular lip or inwardly extending flange proximate a rearward end of the radial restriction member 65*c*. The radial restriction member 65*c* may surround or partially surround the compression portion 60, wherein the internal annular lip of the radial restriction member 65*c* may be configured to contact the compression portion 60 prior to or upon axial compression of the connector 100. The radial restriction member 65*c* may be comprised of stainless steel or other substantially rigid materials which may structurally assist the crack and seal process of compression portion 60. For instance, when the compression portion 60 is axially compressed in a direction towards the coupling member 30, the radial restriction member 65*c* may axially displace along with the compression portion 60 and may prevent the compression portion 60 from splintering or otherwise displacing in a direction other than substantially axial towards the coupling member 30. Additionally, the internal lip proximate the rearward end of the radial restriction member 65*c* may provide an engagement surface for operable engagement with a compression tool, or other device/means that provides the necessary compression to compress seal connector.

Figure 9:
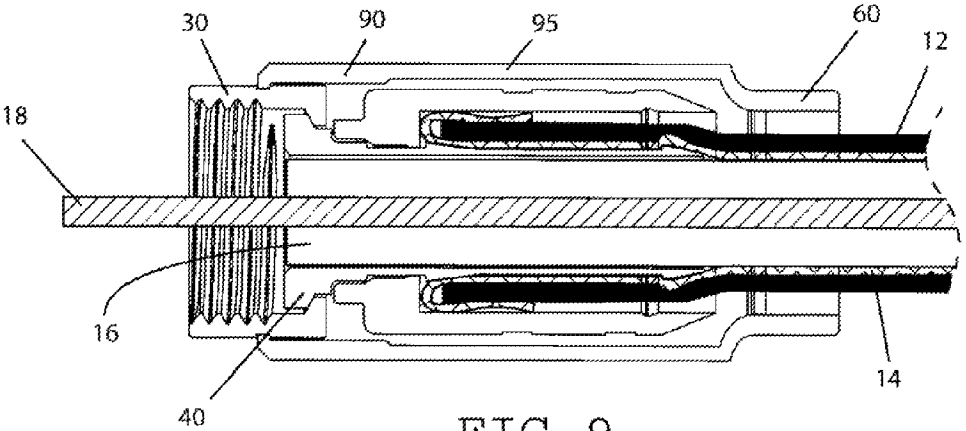
FIG. 9 depicts a cross-sectional view of an embodiment of the coaxial cable connector affixed to a prepared end of a coaxial cable, prior to compression.
Figure 11:
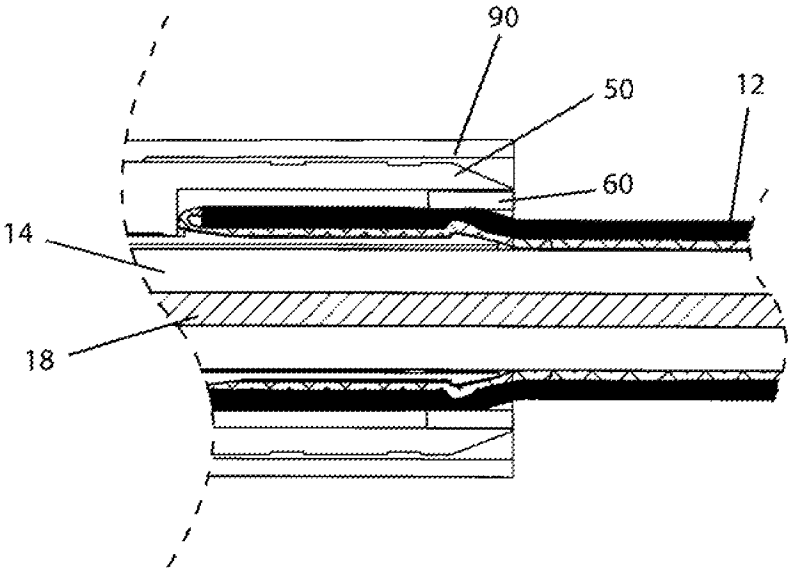
FIG. 11 depicts a cross-section view of an embodiment of a compression portion operating within an embodiment of a connector body.
Figure 12:
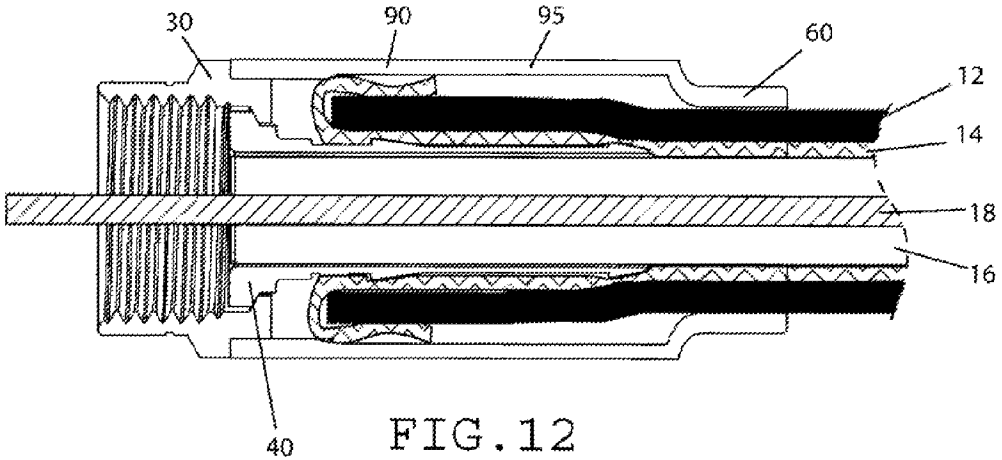
FIG. 12 depicts a cross-sectional view of an embodiment of the coaxial cable connector without a connector body in a position prior to compression.
Figure 13:
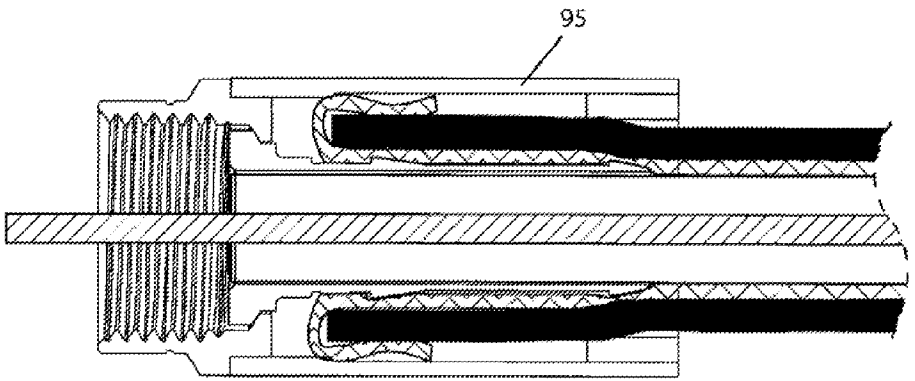
FIG. 13 depicts a cross-sectional view of an embodiment of the coaxial cable connector without a connector body in a compressed position.

Referring now to FIGS. 9-13, embodiments of the compression portion 60 may create an environmental seal around the coaxial cable 10 when in the fully compressed position. FIG. 9 depicts an embodiment of connector 100 in an assembled configuration, wherein the connector 100 has been placed onto a prepared end of a coaxial cable 10, but not compressed into a compressed position onto the coaxial cable 10. Specifically, when the compression portion 60 (and potentially the radial restriction member 65) is axially slid/forced towards the coupling member 30, the structural connection between the compression portion 60 and the outer sleeve 90 is severed/ruptured and the compression portion 60 can come into contact with the outer ramped surface 55 of the connector body 50 and slide over the connector body 50. The ramped surface 55 of the connector body 55 may ensure even, gradual compression upon severing or the rupture of the frangible connection 96*a*, 96*b* between the outer sleeve 90*a*, 90*b* and the compression portion 60 onto the outer jacket 12 of the coaxial cable. For example, the compression portion 60, when broken off from the outer sleeve 90, can deform the outer ramped surface 55 onto the outer cable jacket 12 to form a seal, as shown in FIG. 10. Alternatively, when the frangible connection 96*a*, 96*b* between the outer sleeve 90 and the compression portion 60 is severed/ruptured, the compression portion 60 can slide within the connector body 50, as shown in FIG. 11. In a further alternative embodiment, when the frangible connection 96*a*, 96*b* between the outer sleeve 90 and the compression portion 60 is severed/ruptured, the compression portion 60 can slide directly over and onto the jacket 12 of the cable 10 and compress the cable 10 to form a seal, as shown in FIGS. 12 and 13. Accordingly, the compression portion 60 and potentially the radial restriction member 65 may be referred to as a crack and seal compression means with a radial restriction member 65. Those skilled in the requisite art should appreciate that the seal may be created by the compression portion 60 without the radial restriction member 65. However, the radial restriction member 65 significantly enhances the structural integrity and functional operability of the compression portion 60, for example, when it is compressed and sealed against an attached coaxial cable 10.

Referring to FIGS. 1-3, a method of forming a seal around a coaxial cable 10, may include the steps of providing a post 40 configured to receive a center conductor 18 surrounded by a dielectric 16 of the coaxial cable 10, a coupling member 30, axially rotatable with respect to the post 40, an outer sleeve 90 engageable with the coupling member 30, the outer sleeve 90 having a first end 91 and a second end 92, wherein rotation of the outer sleeve 90 rotates the coupling member 30, and a compression portion 60 structurally integral with the outer sleeve 90, and axially compressing the compression portion 60 to rupture a frangible connection 96 between the outer sleeve 90 and the compression portion 60.

While this disclosure has been described in conjunction with the specific embodiments outlined above, it is evident that many alternatives, modifications and variations will be apparent to those skilled in the art. Accordingly, the preferred embodiments of the present disclosure as set forth above are intended to be illustrative, not limiting. Various changes may be made without departing from the spirit and scope of the invention, as required by the following claims. The claims provide the scope of the coverage of the invention and should not be limited to the specific examples provided herein.

What is claimed is:

1. A coaxial cable connector comprising:

a post configured to receive a center conductor surrounded by a dielectric of a coaxial cable;

a coupling member, axially rotatable with respect to the post;

an outer sleeve engageable with the coupling member, the outer sleeve having a first end and a second end, wherein rotation of the outer sleeve rotates the coupling member;

a compression portion structurally integral with the outer sleeve, wherein the compression portion is configured to break apart from the outer sleeve when axially compressed; and a separate radial restriction member attached to the compression portion to restrict radial expansion of the compression portion.

2. The coaxial cable connector of claim 1, wherein the radial restriction member comprises at least one strap positioned around at least a section of the compression portion.

3. The coaxial cable connector of claim 1, wherein the compression portion breaks apart from the outer sleeve to form an annular seal around the coaxial cable.

4. The coaxial cable connector of claim 1, wherein the outer sleeve includes an engagement member configured to mate with a retaining structure of the coupling member.

5. The coaxial cable connector of claim 1, wherein the compression portion is disposed within the outer sleeve proximate the second end prior to axial compression of the compression portion.

6. The coaxial cable connector of claim 1, wherein the compression portion protrudes from the second end of the outer sleeve prior to axial compression of the compression portion.

7. The coaxial cable connector of claim 1, further comprising a connector body, wherein the connector body includes an outer ramped surface to facilitate gradual compression of the connector body onto a coaxial cable.

8. The coaxial cable of claim 1, wherein the compression portion and the outer sleeve are a plastic, one-piece molded component.

9. A coaxial cable connector comprising:

a post having a first end, a second end, and a flange proximate the second end, wherein the post is configured to receive a center conductor surrounded by a dielectric of a coaxial cable;

a coupling member operably attached to the post, the coupling member having a first end and a second end; and a means for providing a seal around the coaxial cable, wherein the means includes a breakaway compression portion frangibly connected to an outer sleeve;

wherein a seperate radial restriction member is attached to the compression portion to restrict radial expansion of the compression portion.

10. The coaxial cable of claim 9, wherein the breakaway compression portion and the outer sleeve are a plastic, one-piece molded component.

11. The coaxial cable connector of claim 9, further comprising a connector body, wherein the connector body includes an outer ramped surface to facilitate gradual compression of the connector body onto the coaxial cable.

12. The coaxial cable connector of claim 9, wherein the outer sleeve is engageable with the coupling member.

* * * * *